United States Patent [19]

D'Andrade et al.

[11] Patent Number: 4,458,440

[45] Date of Patent: Jul. 10, 1984

[54] TOY BARN AND SILO

[75] Inventors: Bruce M. D'Andrade, Whitehouse Station, N.J.; Liu S. Wong, Hong Kong, Hong Kong

[73] Assignee: Arco Industries Ltd., Hong Kong, Hong Kong

[21] Appl. No.: 373,422

[22] Filed: Apr. 30, 1982

[51] Int. Cl.[3] ..... A63H 33/00

[52] U.S. Cl. ..... 446/424; 446/476

[58] Field of Search ..... 46/12, 11, 13, 19, 18, 46/116

[56] References Cited

U.S. PATENT DOCUMENTS

| | | | |
|---|---|---|---|
| 2,050,892 | 8/1936 | Marx | 46/12 |
| 2,480,030 | 8/1949 | Karwacki | 46/12 |
| 2,522,160 | 9/1950 | Borchers | 46/12 |
| 3,071,890 | 1/1963 | Cohn | 46/12 |
| 3,650,064 | 3/1972 | Fusco | 46/12 |
| 3,789,538 | 2/1974 | Spengler et al. | 46/12 |
| 3,841,018 | 10/1974 | Reiling, Jr. | 46/12 |
| 4,118,886 | 10/1978 | Bartoo | 46/12 |
| 4,139,967 | 2/1979 | Kuna et al. | 46/12 |

*Primary Examiner*—Mickey Yu

*Attorney, Agent, or Firm*—C. Hercus Just

[57] ABSTRACT

A toy barn and silo connected thereto in which an elevator is operable to receive and elevate toy hay bales to the loft of the barn and eject them into and through the loft for discharge into a vehicle in a bay of the barn. The barn below the loft has stalls closed by gates and containing animals which can be ejected from the stalls by plungers and the gates are opened by discharge movement of the animals.

5 Claims, 7 Drawing Figures

Fig. 1
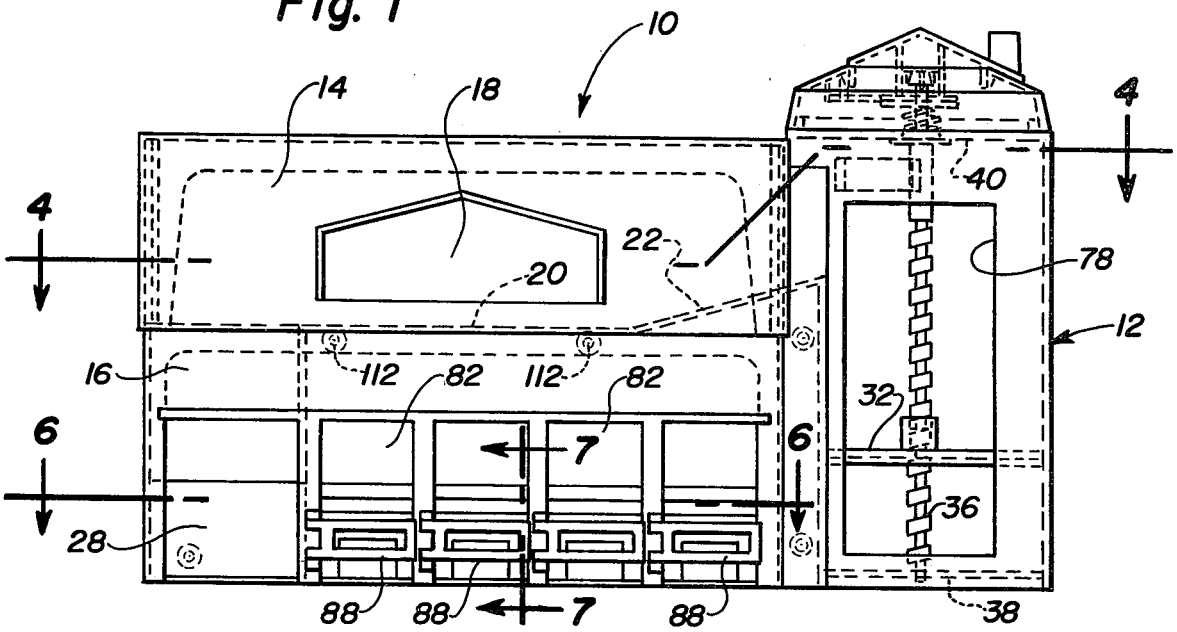
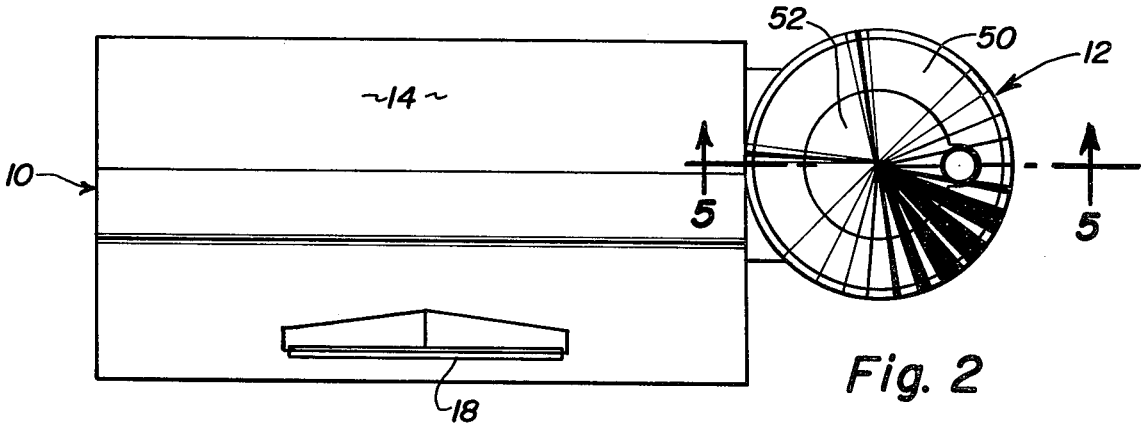
Fig. 2
Fig. 3
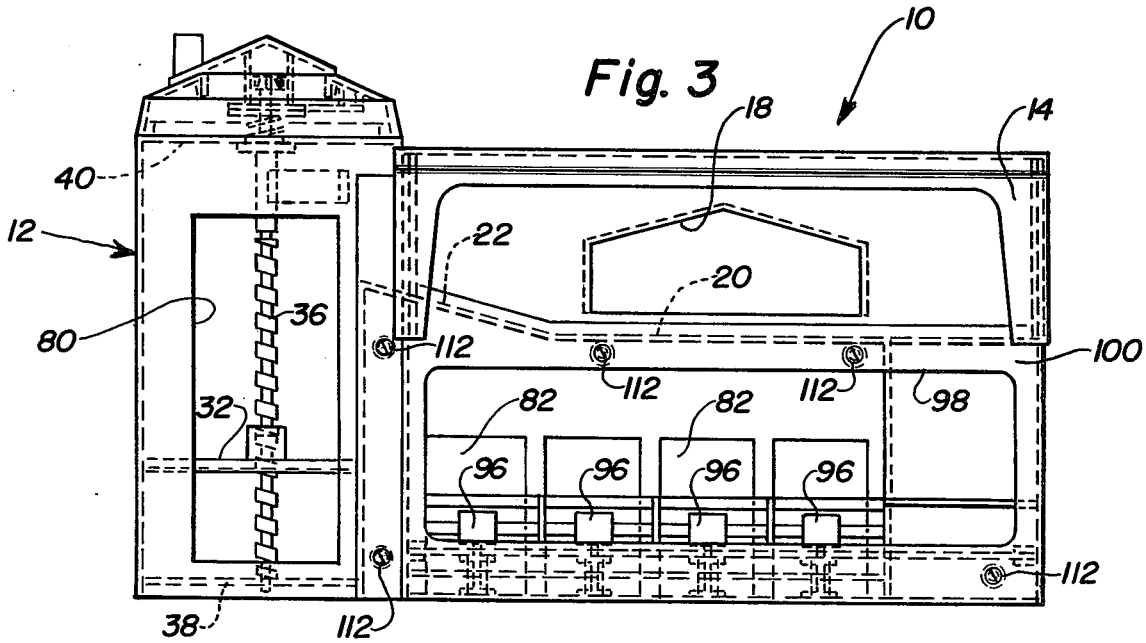

TOY BARN AND SILO

BACKGROUND OF THE INVENTION

The present invention pertains to a toy barn to which a silo is connected and various novel means are included in the same. Toy buildings of certain types, such as doll houses, are well known and various design have been employed in the same over the years. At least one attempt has been made to include in a toy house such as a doll house an elevator which is manually operated by a cord that is counter-balanced and is illustrated in prior U.S. Pat. No. 618,810 to Wood, dated Jan. 31, 1899. A number of so-called floors are provided in vertically spaced relationship in this toy house and are served by the elevator.

Other attempts to provide toy buildings are evidenced in prior U.S. Pat. Nos. 2,480,030, to Karwacki, dated Aug. 23, 1949, and 2,522,160, to Borchers, dated Sept. 12, 1950, these patents pertaining to garage-type buildings and are concerned with housing toy vehicles adapted to be moved in various ways through openings closed by doors adapted to be moved to open position incident to ejecting the vehicles through the open door of the building, plungers of different types being utilized to effect operation of the houses.

The art as presently known to the present inventor relative to toy barns and the like appears to be non-existing, yet interesting features are possible of being developed in relation to barns and silos as evidenced by the present invention, details of which are described below.

SUMMARY OF THE INVENTION

It is among the principal objectives of the present invention to provide a toy barn having a vertical silo connected thereto adjacent one end, the silo having an elevator adapted to be manually raised and lowered for purposes of moving objects, especially of a farm nature, such as toy bales of hay, upwardly to the level of a loft floor in the upper part of the barn and discharge the same from a platform of the elevator by means operated incident to raising the elevator.

It is another object of the invention to provide a top for the silo which also serves as manually operable means to raise and lower the platform of the elevator which is accomplished by means of a screw threaded through the platform and at least a part of the top of the silo is connected to the upper end of the screw for manually operating the same when said part of the top of the silo is rotated manually.

Another object of the invention ancillary to the foregoing object comprises the inclusion of a slip clutch preferably adjacent the upper end of the screw which actuates the platform of the elevator in order that when the platform reaches a predetermined upper limit, no damage will occur if the rotatable actuator continues to be moved.

Still another object of the invention is to provide on said screw adjacent the upper end thereof, an ejecting member which is movable incident to the rotation of the screw and, when the elevator reaches a pre-determined height in the silo, said ejector member picks the object on the platform of the elevator from it onto the loft floor of the barn, preferably descending by means of a sloping ramp.

Another object of the invention is to provide in the barn at a level below the loft floor a plurality of compartments extending inward from the front of the barn and comprising stalls for toy animals, the front of the stalls being normally closed by hinged gates, and ejecting means which are manually operable are ranged to have pushers engaging the inner ends of toy animals when disposed in the stall and are operable to push the animals against the gates of the stalls and pop the gates open for purposes of ejecting the animals from the stalls.

A still further object of the invention is to provide at the end of the barn opposite that to which the silo is connected a discharge opening in the floor of the loft, whereby toy objects such as bales of hay may be discharged into a toy vehicle or the like disposed in a bay adjacent one of the stalls of the barn.

Details of the foregoing objects and of the invention, as well as other objects thereof, are set forth in the following specification and illustrated in the accompanying drawings comprising a part thereof.

BRIEF DESCRIPTION OF THE DRAWINGS

FIG. 1 is a front elevation of a barn and silo embodying the principles of the present invention.

FIG. 2 is a top plan view of the barn and silo shown in FIG. 1.

FIG. 3 is a rear elevation of the barn and silo shown in FIGS. 1 and 2.

DETAILED DESCRIPTION OF THE PREFERRED EMBODIMENT OF THE INVENTION

Referring to the various figures of the drawings, it will be seen that the preferred manner of manufacturing the toy barn and silo comprising the present invention is to mold the same preferably from plastic material into various shapes of panels and related configuration by which ease of manufacture and particularly ease of assembly and interconnection of the various elements may be achieved. It is to be understood, however, that the present invention is not to be restricted to being manufactured from plastic material, but may be formed from other appropriate material such as wood panels, sheet metal, fiber board, and various other appropriate material.

Figure 4:
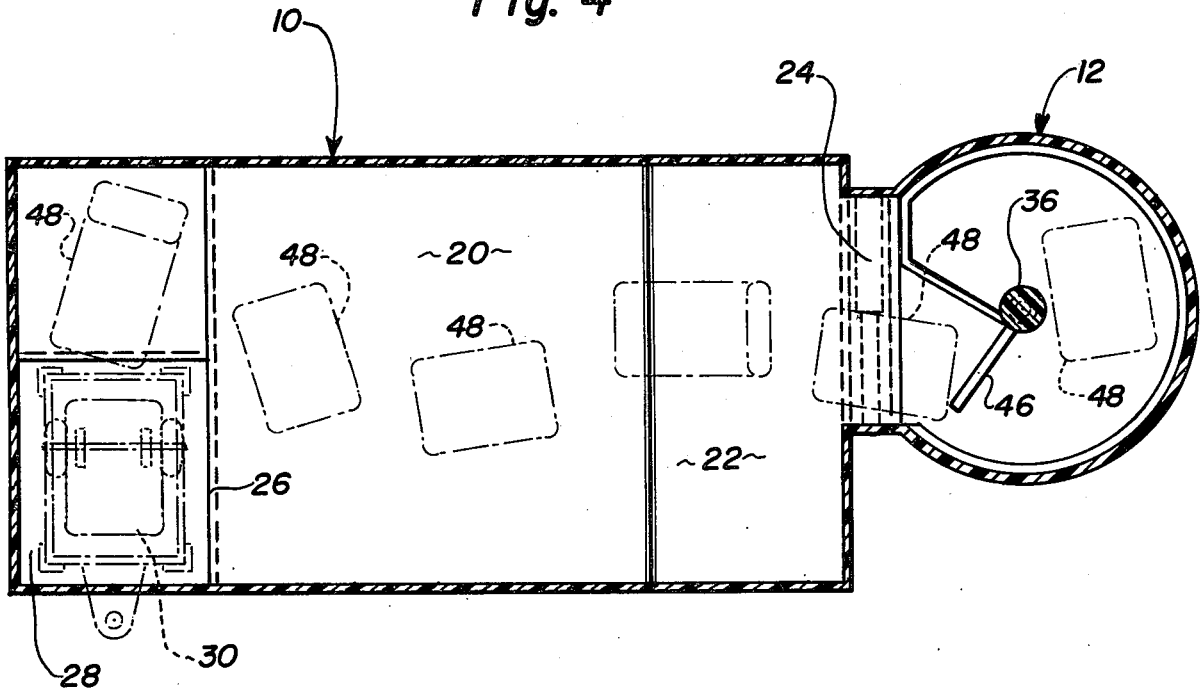
FIG. 4 is a horizontal sectional view of the barn and silo shown in FIG. 1 as seen on the line 4—4 thereof.
Figure 5:
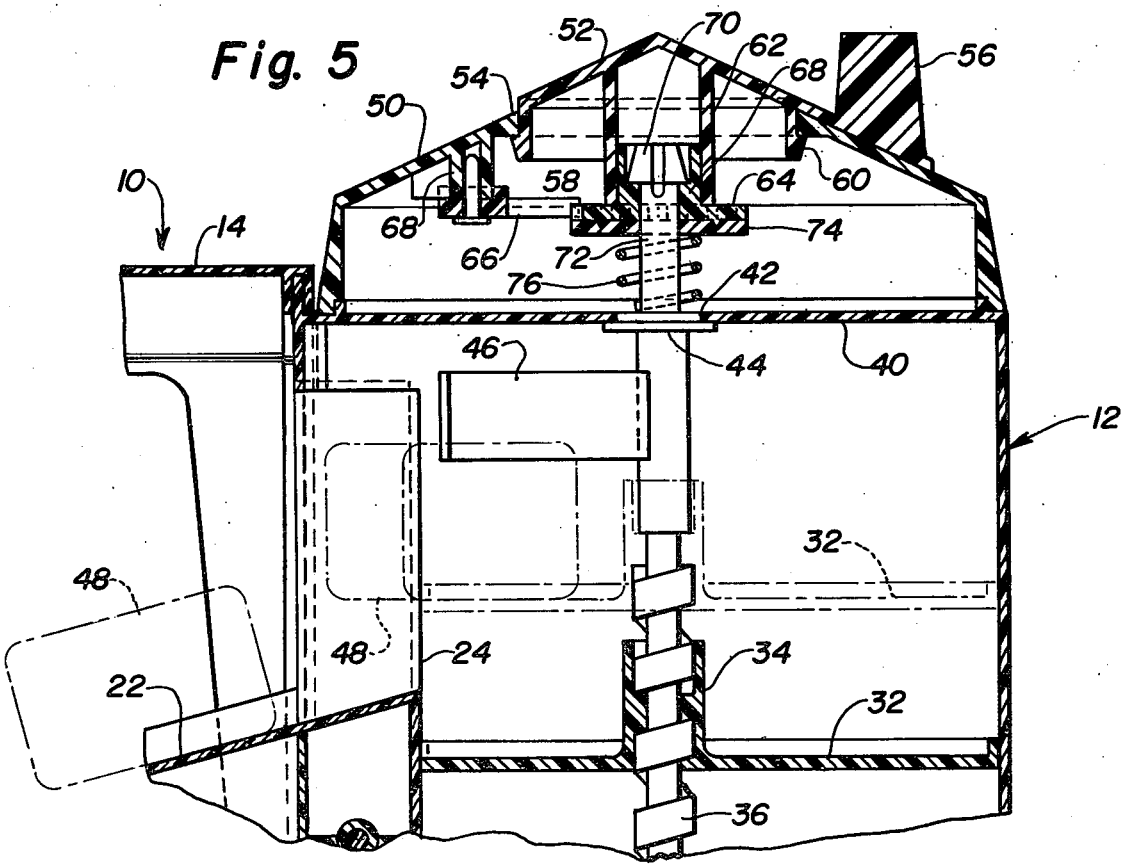
FIG. 5 is a fragmentary vertical sectional view especially of the upper portion of the silo, as seen on the line 5—5 of FIG. 2 and being illustrated in a larger scale than in the preceding figure.

The toy primarily consists of a barn building 10 and a silo 12 preferably integrally connected to the barn building. The barn building has a roof 14 formed of appropriate panels and at least one of the roof panels facing toward the front 16 of the barn building has a window 18 formed therein as clearly shown in FIGS. 1–3. The barn building, substantially at the roof line of the same, also is provided with a horizontal loft floor 20 which, at the end nearest the silo 12 slopes upwardly to form a ramp 22, the upper end of the ramp 22 emerging into an opening 24 disposed within the interior of the silo 12 as best shown in FIG. 5. The opposite end of the loft floor 20 has another relatively square opening 26 which is directly above a bay 28 below the loft floor and and adapted to receive a toy farm wagon 30 or the like to receive objects moved along the loft floor 20 and discharged through the opening 26 to fall by gravity into the vehicle 30 for example.

Vertically movable within the silo 12 is an elevator platform 32 having an internally threaded boss 34, see FIG. 5, through which a vertical screw 36 extends. The lower end of the screw extends through a bearing hole in a horizontal bottom panel 38 in the lower portion of the silo 12, see FIG. 3. The upper end of the silo also has a horizontal panel 40 provided with a central opening 42, see FIG. 5, relative to which a stepped bearing member 44 is received to position the upper end of the screw 36 vertically within the silo 12, the panel 40 being suitably connected to the upper ends of the walls of the silo 12.

The screw 36 is rotated by means described below and the upper portion of the screw has a discharge member 46 fixed to and extending radially therefrom at a level above the opening 24 and the ramp 22, whereby when the elevator platform 32 raises an object such as a toy bale of hay 48 to a level above the ramp 22 for example, as shown in phantom in FIG. 5, said object will be engaged by the discharge member 46 and kick the same down the ramp 22 onto the loft floor 20. As such objects accumulate upon the loft floor, they will gradually push each other toward the discharge opening 26, particularly as partly encouraged in such movement by the sloping ramp 22.

The silo 12 terminates at the top in a somewhat conical circular top 50 which also has a top member 52 extending through an opening 54 in the top 50 which comprises a bearing opening for the top member 52 and relative to which the top member is rotatable, while the top 50 remains stationary with respect to silo 12. The top member 52 is also provided with a lateral extension from which a crank member 56 projects. The top member 52 has a downwardly extending cylindrical wall 58 which actually is a bearing member rotatable within the opening 54 and the wall 58 has an annular shoulder 60 which engages the lower surface of the portion of top 50 which contains the bearing opening 54 to accurately position the top member 52 relative to the top 50 and especially to prevent relative upward movement of the top member 52 with respect to top 50.

Extending downward from the interior of top member 52 and integral therewith is a sleeve 62 which is connected at its lower end to a circular plate 64 comprising part of the slip clutch. The periphery of the plate 64 is serrated for purposes of engaging a flexible spring blade 66 which is fixedly supported by a stud 68 connected to the interior of top 50 as clearly shown in FIG. 5. As the top member 52 is rotated, it will also rotate the circular plate 64 and the periphery will engage the end of the spring blade 66 with a clacking type of noise to provide amusement during the operation of the elevator within the silo.

On the interior of the sleeve 62 is a cup-shaped member 68 having an interior shoulder upon which is seated a flexible terminal end 70 of the screw 36 which projects above the horizontal panel 40, said flexible terminal end 70 being preferably frusto-conical in shape, opposite sides of which snap into engagement with the shoulder on the interior of the cup-shaped member 68 incident to assembling the interrelated components just described.

Fixed to the upper end portion 72 of screw 36 is a clutch plate 74 which coacts with circular plate 64 and completes the formation of a slip clutch, the abutting surfaces of said plates preferably being roughened for frictional engagement and a compression spring 76 urges the clutch plate 74 into engagement with plate 64. In operation, should the screw 36 be moved in elevating rotation with respect to the elevator platform 32 and raise the same beyond the intended upper limit thereof, followed by continued rotation of top member 52, the clutch will slip even though rotation of the top member 52 and circular plate 64 continues, whereby no damage to the elevator and screw will occur. From FIGS. 1 and 3, it also will be seen that the front of the silo 12 is provided with a loading opening 78 and, similarly, the rear portion of the silo is provided with an access opening 80 as shown in FIG. 3.

The lower portion of the barn 10 is provided with a plurality of compartments comprising stalls 82 having front openings in the front wall 16 of the barn. The stalls extend forwardly from a rear wall 84 and are adapted to contain toy animals such as the simulated pigs 86. The front openings of the stalls normally are closed by gates 88. Plunger means 90 have pusher faces 92 thereon, the plunger means 90 preferably being in the form of elongated inverted channels having parallel sides 94, said channels being slideable upon vertical strips 95, one of which is clearly shown in FIG. 6.

The rearward ends of the plunger means 90 are provided with upstanding knobs 96 for manual engagement, said knobs redily being accessible through an extensive opening 98 formed in the rear wall 100 of the barn 10. By pushing forwardly on the knobs 96, the pusher faces 92 engage the rear end of an animal 86 and thereby push the same against the gate 88 of the stall 82 in which the animal is contained and a releasable latch 101 yields in order to permit the gate 88 to pop open in order that the animal may be discharged from the stall 82.

Figure 6:
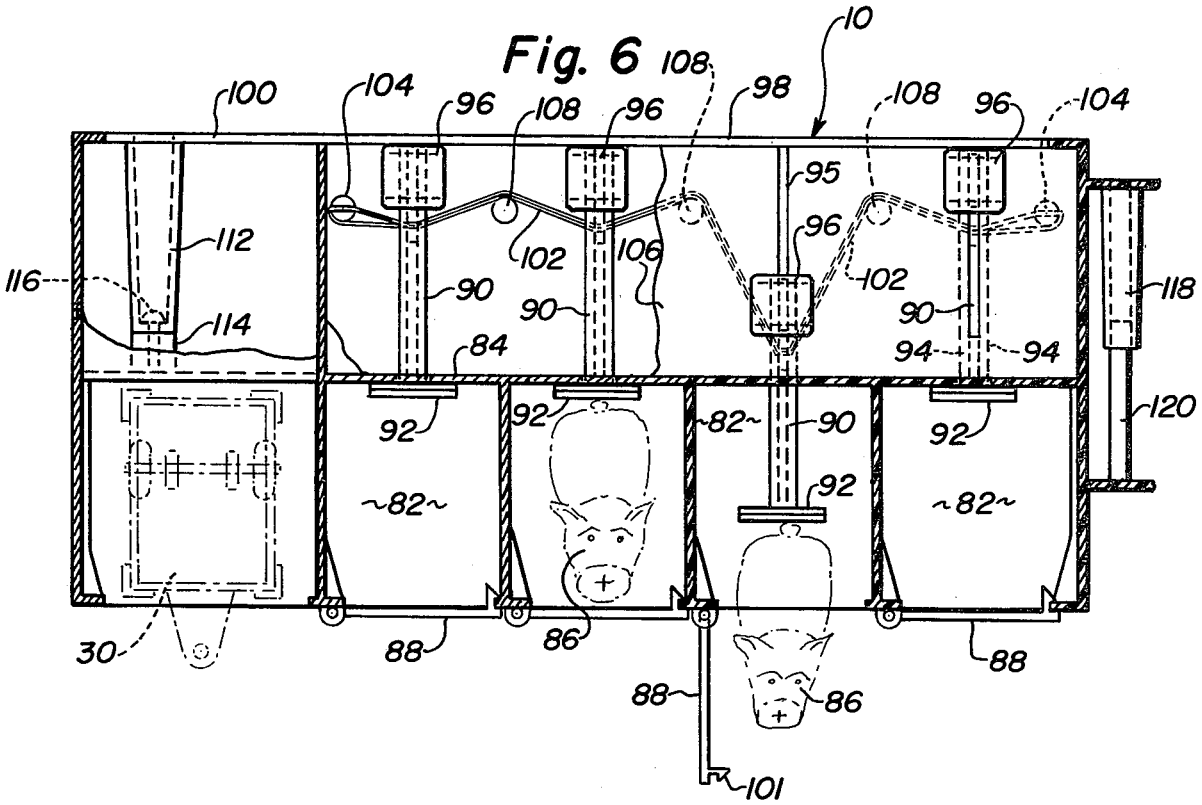
FIG. 6 is a horizontal sectional plan view of the lower portion of the barn and of the structure shown in FIG. 1 as seen on the line 6—6 thereof.
Figure 7:
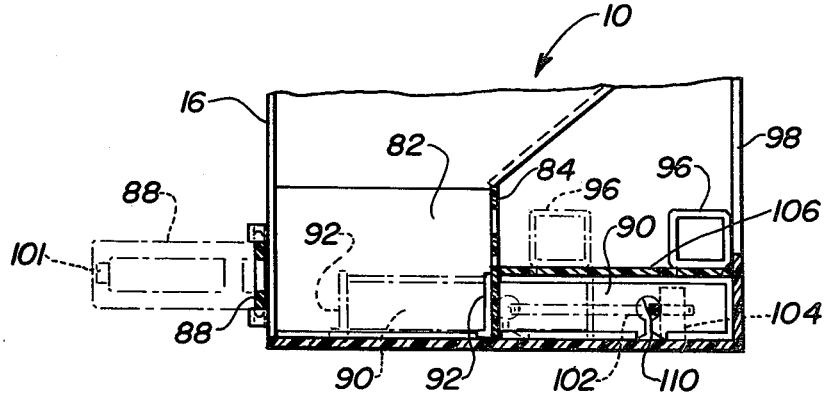
FIG. 7 is a fragmentary vertical sectional view of one of the stalls of the barn shown in FIG. 1 as seen on the line 7—7 thereof, the position of certain of the elements being shown in full lines and alternate positions thereof being illustrated in phantom.

For purposes of retracting the plunger means 90, a preferably elongated elastic member 102 is provided and extends between fixed posts 104 located in a space below the horizontal plate 106, best shown in FIG. 7, which overlies the plunger means 90, the left-hand end of plate 106 being broken away as shown midway of FIG. 6. Said elastic member conveniently may be in the form of a rubber band which is disposed rearward of a plurality of additional posts 108 but the portions of the elastic member 102 which extend between the posts 108 and also the posts 104 extend through openings 110 in the walls of the plunger means 90, whereby as the plunger means 90 are pushed forwardly for the above described purpose, the portion of the elastic member extending through the opening 110 of said plunger means is extended as shown in the phantom illustration thereof in FIG. 6 relative to the next to the end stall from the right-hand end of the barn building 10. Upon manually releasing the knob 96 of that particular plunger means, the elastic member 102 will immediately retract the plunger means to its initial position.

As indicated above, the various panels and configurations of other components of the barn building and silo are preferably molded from appropriate, preferably relatively stiff plastic material and the same are fitted together appropriately to form the assembled toy. Referring to FIG. 6, for example, it will be seen that the rear wall 100 of the barn building 10 may be provided with a tubular projection 112 extending forward for abutment with boss 114 molded on the rearward surface of rear wall 84 as shown in FIG. 6 and any appropriate means such as a forced pin 116 provides connection between certain of the elements. Similarly, at the right-hand end of FIG. 6, it will be seen that another tubular projection 118 is engaged either by force fit or cement with a pin 120, the projection 118 and pin 120 respectively being integrally molded with two other components of the building which require connection. Appropriate means such as these are shown also in FIG. 3, wherever desired, said means being commonly employed in plastic structures of this type.

From the foregoing, it will be seen that the present invention provides a toy farm structure comprising a barn building and associated silo having a number of manually operable features which offer amusement to children in simulating play pertaining to actual farms such as by elevating bales of hay and the like to the loft of the barn and discharging the same into a farm wagon, as well as containing toy animals in stalls or pens and ejecting the same therefrom when desired.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

We claim:

1. A toy barn building having a front and a loft floor and a silo adjacent one end of the barn building, provided with an opening in said front to receive farm objects to be stored, an elevator in said silo including a platform operable to receive farm objects through said opening, means to elevate said platform to and from the level of said loft floor in the barn building, means operable in said silo to discharge elevated objects from said elevator platform onto said loft floor when elevated to the level of said floor comprising at the end of the loft floor nearest said silo a sloping ramp between the uppermost elevator position of said platform in said silo and said loft floor, and the opposite end of said loft floor terminating at an opening above a bay in the barn building at a level below said loft floor to accommodate means to receive an object discharged from the loft floor.

2. The toy barn building according to claim 1 which further includes a conical roof member and said means to elevate said platform of said elevator comprises a rotatable vertical screw threaded through said platform and the upper end of said screw being fixed to said roof member by which the screw is rotated, and a manually operated crank connected to said roof member to rotate said screw in opposite rotary directions respectively to elevate and lower said platform.

3. The toy barn building according to claim 2 further including a radial discharge member connected to said screw at a level above said loft floor and operable to abut said farm objects when elevated upon said platform and move them from said platform onto said loft floor.

4. The toy barn building according to claim 1 in which said roof member is connected to the upper end of said screw by a slip clutch to prevent damage in the event the platform reaches an uppermost limit and rotation of said screw is continued, said clutch comprising a pair of similar friction plates coengaging each other and respectively fixed to said roof member and the upper end of said screw, and a compression spring extending between said roof member and said friction clutch plates and operable to urge them into releasable frictional engagement to function as a slip clutch.

5. The toy barn according to claim 1 further including therein at a level below said loft floor a row of compartments comprising stalls extending inward from said front of the barn and each having a relatively low horizontal front gate pivotally supported at one end and extending across the front of said compartments, plunger means having pusher members movably supported at the inner ends of said stalls and operable manually to engage toy animals when in said stalls and push the same against said gates to open the same and eject the animals from said stalls, and means operable to retract said plunger means automatically when manually released.

* * * * *